US006449789B1

(12) United States Patent
Krass et al.

(10) Patent No.: US 6,449,789 B1
(45) Date of Patent: Sep. 17, 2002

(54) AUTOMOTIVE VEHICLE DOOR AND LOCK STRIKER ADJUSTMENT TOOL

(75) Inventors: Craig R. Krass, Rockford; Michael Cooling, Pecatonica; Pat Morral, Belvidere, all of IL (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/574,640

(22) Filed: May 18, 2000

(51) Int. Cl.[7] ..... B25D 1/04

(52) U.S. Cl. ..... 7/143; 7/166; 7/138; 81/58; 81/60

(58) Field of Search ..... 7/143, 166, 138; 81/58, 58.1, 58.2, 58.3, 58.4, 59.1, 60, 61, 62, 63

(56) References Cited

U.S. PATENT DOCUMENTS

| | | | | |
|---|---|---|---|---|
| 48,027 | A | | 5/1865 | Park |
| 159,561 | A | | 2/1875 | Button |
| 348,565 | A | | 9/1886 | Mandeville |
| 977,672 | A | | 12/1910 | Modrall |
| 1,417,725 | A | | 5/1922 | Fullenwider |
| 3,130,762 | A | | 4/1964 | Kerr |
| 4,558,726 | A | | 12/1985 | Clay |
| 4,572,040 | A | * | 2/1986 | Metz |
| 4,924,544 | A | | 5/1990 | Culotta |
| 5,970,552 | A | * | 10/1999 | Kwiecien et al. |

* cited by examiner

*Primary Examiner*—Joseph J. Hail, III
*Assistant Examiner*—Willie Berry, Jr.
(74) *Attorney, Agent, or Firm*—Ralph E. Smith

(57) ABSTRACT

A multiple function automotive door adjustment tool is provided. The adjustment tool has a lightweight polymeric hammerhead having one end with a hard plastic impact member and an opposite end with a soft rubber impact member. The adjustment tool has a handle with a lower end adapted for insertion into a socket. The socket has a lower end for connection with a drive member. The plastic impact member is utilized to hit the striker to adjust a position of the striker with relationship to the vehicle car body. The rubber impact member is utilized to hit the door without damaging the finish thereof. The single adjustment tool eliminates the use of three previously required adjustment tools and performs the same functions.

6 Claims, 1 Drawing Sheet

AUTOMOTIVE VEHICLE DOOR AND LOCK STRIKER ADJUSTMENT TOOL

FIELD OF THE INVENTION

The present invention relates to a tool used to align an automotive vehicle door. More particularly, the present invention relates to a multi-functional tool used to adjust the alignment of an automotive vehicle door and to torque the bolts on the striker which, in conjunction with the lock of the vehicle door, retains the vehicle door in a closed position.

BACKGROUND OF THE INVENTION

Automotive vehicles comprise a plurality of body panels which are attached to an underlying chassis. On a side of the vehicle, there is a front fender, a front door panel, an a rear fender and an optional rear door panel. To most automobile purchasers, the fit between the various side body panels is a major indicator of vehicle quality. To provide an aesthetically pleasing appearance, the gap between the door and any adjacent body panel or pillar should be held to as tight a tolerance as possible. Additionally, the gap between the door and its adjoining body panels should be held to a constant dimension as much as possible. Controlling the gap between the door and the adjoining body panels is complicated by several factors which can continually vary. The first factor is differences in stampings caused by wear of the sheet metal dies which stamp out the panels. The dimensional stability of the vehicle door opening is another factor which can vary. Still another important factor is the final shape and attachment location of the door hinge, the door latch hardware and the door lock striker. Typically, when a vehicle is manufactured, the door envelope which is usually a generally rigid panel and its accompanying rigid inner door panel are connected to the vehicle during the painting process for the prime coating and finish coating. Much of the hardware associated with the door is often added to the door after completion of the painting process. Accordingly, final adjustment of the hinge and the striker which interacts with the locking system of the door typically occurs after completion of the painting process. When making adjustments to the door hinge or to the striker, there is a need for a hammer having a non-marring impact member which however is generally hard. When the door latch or the striker must be struck, a door adjustment assembler who is responsible for final adjustment of the vehicle door will typically use a hammer with a hard plastic impact member. To adjust the position of the vehicle door with respect to the hinge or to slightly deform the metal that the hinge is adjoined to, it is sometimes necessary for the door adjustment assembler to actually strike a vehicle door. When striking the vehicle door, a hammer with a very soft impact head must be utilized. Striking the door with a hard plastic impact member can inadvertently cause a marring of the door finish painted surface and the vehicle will have to be taken off the assembly line to a repair area which greatly increases manufacturing costs. Additionally, the bolts that attach the door lock striker to the door opening of the vehicle must often be torqued or untorqued to allow for positional adjustment.

Presently, the door adjustment assembler must carry or have available three separate tools. The first tool is a hammer which has a generally hard, non-marring impact member such as a plastic for hitting the striker or the door hinge. The second tool is a hammer which has a generally soft rubber impact member that will not mar the finish paint on the vehicle door. The third tool is a wrench which has a head for turning the bolts which hold the striker. Utilizing three different tools is a significant burden to a door adjustment assembler who must repeat the adjustment procedure for each vehicle door. Additionally, an efficiency problem arises because after a tool has been used, it must be placed back in its proper place and another tool picked up. Continually picking up and putting down the separate tools can cause a negative ergonomic effect. Ergonomically, the weight of the hammer and the repetitive hand motions can expose the door adjustment assembler to a greater risk of carpal tunnel syndrome, a peripheral nerve entrapment neuropathy which is the most common cause of paresthesia in the first three fingers and of nocturnal paresthesia.

It is desirable to provide a multi functional tool to reduce the number of tools and the total weight of tools which a door adjustment assembler must use. It is also desirable to provide a lighter door adjustment tool which decreases any potential risk to carpal tunnel syndrome.

SUMMARY OF THE INVENTION

To make manifest the above-delineated desires, the revelation of the present invention is brought forth. A multiple function automotive vehicle door enclosure and door lock striker adjustment tool which frees the door adjustment assembler from the burden of carrying three separate tools is provided. In a preferred embodiment, the multiple function automotive vehicle enclosure door and door lock striker adjustment tool of the present invention includes a lightweight polymeric hammerhead. The lightweight polymeric hammerhead reduces the strain from handling the tool and accordingly ergonomically reduces the risk of carpal tunnel syndrome to the door adjustment assembler. The hammerhead of the present invention has a first diametrically enlarged cylindrical end. The first cylindrical end has an internally threaded bore penetrating axially into it. The hammerhead has a reduced diameter mid portion allowing the door adjustment assembler to better grip the tool and torque the tool bit with two-hand control when required. The hammerhead has a second end opposite the first end which is also enlarged and also has a threaded blind bore extending axially therein. The first end of the hammerhead has a non-marring hard plastic impact member for impacting the striker or the door hinge. The first impact member has a threaded stud along its inner surface which allows the first impact member to be threadably connected with the first end of the hammerhead. A second impact member is provided. The second impact member is made from a soft elastomeric rubber. The second impact member also has an inner surface with a projecting threaded stud to allow the second impact member to be threadably connected to the second end of a hammerhead. The second impact member is utilized when the assembler operator wishes to strike the vehicle door especially along its outer painted surfaces. The tool of the present invention has a handle. The handle has a top end which is inserted into a generally matching radial bore of the hammerhead mid portion. A dowel pin fixedly connects the top end of the handle with the hammerhead. A lower end of the hammer is adapted to fit into a ⅜ drive socket and has a spring loaded locking pin associated therewith. There is additionally provided a socket extension having a generally axial cavity for receipt of the bottom end of the handle. The socket extension additionally has a lower end which by virtue of a lock washer connects with an annular groove on a drive bit. The drive bit is utilized to torque the bolts which connect the striker to the door opening of the vehicle.

It is an object of the present invention to provide a multi-functional tool which is utilized by a door adjustment assembler to adjust the fit of an automotive vehicle side door.

It is an object of the present invention to provide an automotive vehicle door adjustment tool which is ergonomically superior to prior adjustment tools.

The above objects and other features of the present invention will become more apparent to those skilled in the art as the invention is further revealed in the accompanying drawings and detailed description of the invention.

DETAILED DESCRIPTION OF THE PREFERRED EMBODIMENTS OF THE INVENTION

Figures 1, 2, 3:
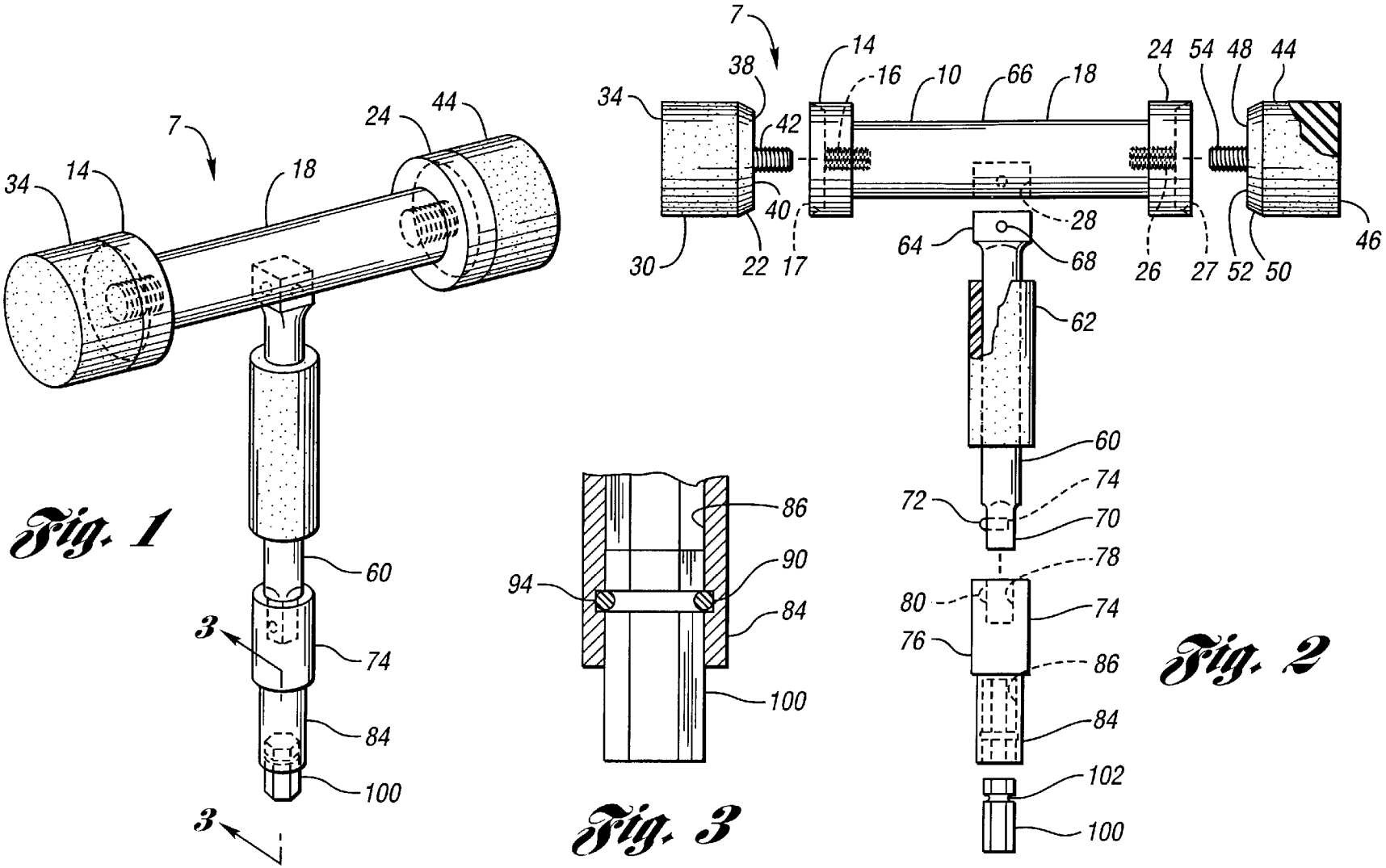
FIG. 1 is a perspective view of a preferred embodiment automotive vehicle door adjustment tool according to the present invention.
FIG. 2 is a front exploded view of the automotive vehicle door adjustment tool illustrated in FIG. 1.
FIG. 3 is a sectional view taking along lines 3—3 of FIG. 1.

FIGS. 1–3 illustrate a preferred embodiment multiple function automotive vehicle enclosure door and door lock striker adjustment tool 7 according to the present invention. The hammerhead 10 is fabricated from a strong, lightweight, rigid polymeric substance such as a nylon or a fiberglass reinforced plastic. The hammerhead 10 is generally cylindrical and has an enlarged diameter first cylindrical end 14. The hammerhead first end 14 has an axial internally threaded blind bore 16 which penetrates the hammerhead. The hammerhead first end 14 also has an annular depression or nest 17. The hammerhead 10 has a reduced diameter mid-portion 18. The mid-portion 18 typically will be 1.25 inches in diameter. The reduction in diameter of the mid-portion 18 allows a door adjustment assembler to grip the adjustment tool 7. The hammerhead mid-portion 18 also has a radial blind bore 28. Opposite the hammerhead first end 14 is a second diametrically enlarged cylindrical end 24. The hammerhead second end 24 also has axial internally threaded blind bore 26 which penetrates its end. The hammerhead second end 24 also has an annular nest 27.

The adjustment tool 7 has a first impact member 30. The first impact member 30 is typically fabricated from a hard plastic. Typically, the first impact member 30 will be two inches in diameter and have a one inch axial length. The impact member 30 has an outer surface 34 for impacting the striker of an automotive vehicle door locking system. The impact member 30 has an inner surface 38. The inner surface 38 has an annular tapered portion 22. The annular tapered portion is seated and laterally aligned by the nest 17. The inner surface 38 also has a generally flat portion 40. The flat portion 40 has projecting therefrom an axial threaded stud 42. The stud 42 is threaded with a ⅜ thread. The threaded stud 42 allows the impact member 30 to be threadably connected with the enlarged first end 14 of the hammerhead.

Opposite the first impact member 34 is a second impact member 44. The second impact member 44 is fabricated from a soft rubber. The second impact member 44 has an outer surface 46 for contact with the vehicle door and is non-marring to the finish paint on the vehicle door. The second contacting member has an inner surface 48. The inner surface 48 has an angular tapered portion 50 and a generally flat portion 52. The generally flat portion 52 has projecting therefrom a stud 54. The stud 54 is threaded with a ⅜ thread. The stud 54 allows the second impact member 44 to be threadably connected with the second end 24 of the hammerhead. The diameters of the first impact member 34, hammerhead first end 14, second impact member 44 and hammerhead second end 24 are essentially the same and would typically be approximately two inches.

The adjustment tool 7 has a handle 60. The handle 60 typically is made from a metallic material and in the embodiment of the invention shown is comprised of a ⅜ inch by 5 inch drive extension. The handle 60 has a hand grip 62 formed from a polymeric material to make the adjustment tool 7 easier to grip and manipulate. In one embodiment of the invention, the grip 62 is adhesively joined and positionally fixed upon the handle 60. In an alternative embodiment, the grip 62 can be repositioned by the door adjustment assembler to a most favored position upon the handle 60. The handle 60 has a top end 64. The top end 64 will have a snug fit within the radial bore 28 of the hammerhead mid portion. A transverse dowel pin 66 which extends through the hammerhead mid-portion 18 and through a transverse bore 68 of the handle top end fixably connects the handle 60 to the hammerhead 10.

A lower end 70 of the handle has a generally square cross section adapted to fit into a drive socket and consists of a standard ⅜ drive. A locking member which can be a ball or pin 72 is spring biased by a spring 74 to radially extend from the lower end 70 of the handle.

A socket extension 74 has a top portion 76. The top portion 76 has a generally rectangular axial cavity 78. The axial cavity 78 is shaped to receive the lower end 70 of the handle. The axial cavity 78 has a radial depression 80 formed by a radial bore which receives the locking pin 72 to connect the handle 60 with the socket 74.

The socket extension 74 has a lower portion 84 that has a hexagonal cross-sectional cylindrical axial cavity 86. The hexagonal cross section allows the socket to impart a torque to an inserted drive bit 100. The axial cavity 86 has an angular groove 90. Mounted within the angular groove 90 is a lock washer 94. The lock washer 94 encircles an annular groove 102 in a ¼ inch drive bit 100. The drive bit 100 can be a ¼ inch English drive, a metric drive, or a Torx drive with dimensional modifications to the lower part 84 of the socket extension.

In operation, a door adjustment assembler will use the hammerhead first end 14 to impact the striker. To achieve the proper adjustment of the door, often the striker must be moved relative to the automotive vehicle body door opening. The required adjustment may be to move the striker up or down. In other instances the striker must be move angularly. The striker attachment bolts must be torqued to a minimum amount, otherwise the striker will fall to the lowest point. The minimum required torque applied on the striker attachment bolts prevents the striker from easily being positionally adjusted and thus striker must be struck in order to move. The door adjustment assembler adjuster will utilize the drive bit 100 to torque the bolts which connect the striker to the door opening.

When using the drive bit 100 the door adjustment assembler can place their hand on hammerhead mid-portion 18. The enlarged first and second ends 14 and 24 aid in gripping the adjustment tool 7 when torquing a striker attachment bolt. If a model change requires the utilization of a different drive bit 100, the drive bit is simply removed and another drive bit of the appropriate size is inserted. The drive bit 100 can also be a screw driver bit or torque bit or any bit which is typically utilized to interact with a head of a threaded fastener. Upon sufficient wear, the impact members 34 or 46 and/or drive bolt 100 can be simply screwed out and replaced. If adjustment of the door is required, the door adjustment assembler will use the second end 24 of the hammerhead to hit the vehicle door.

A preferred embodiment of the adjustment tool has been presented. It will be apparent to those skilled in the art of the various modifications and substitutions which can be made to the present invention without departing from the spirit or scope of the present invention as it is encompassed by the following claims.

What is claimed is:

1. A multiple function automotive vehicle enclosure door and door lock striker adjustment tool comprising:

a light weight polymeric hammerhead, said hammerhead having a first diametrically enlarged cylindrical end with an internally threaded blind bore penetrating there into, said hammer head having a reduced diameter mid-portion allowing an operator to grip said tool, said hammerhead having a second diametrically enlarged cylindrical end opposite said first diametrically enlarged cylindrical end, said second diametrically enlarged end having an internally threaded blind bore extending therein;

a first hard plastic cylindrical impact member having an outer end surface for impact with said automotive vehicle door lock striker, said first impact member having an inner surface with an annular tapered portion and a flat portion, said flat portion having a threaded stud projecting therefrom to allow said first impact member to be threadably connected with said first end of said hammerhead;

a second soft rubber cylindrical impact member having an outer end surface for impact with said vehicle door, said second impact member having an inner surface with an annular tapered portion and a flat portion, said flat portion having a threaded stud projecting therefrom to allow said first impact member to be threadably connected with said second end of said hammerhead;

an elongated member providing a handle for said tool, said handle having a top end for insertion into a generally transverse radial bore of said reduced diameter mid-portion of said hammerhead and being fixably connected thereto by a dowel pin, said handle having a lower end having a generally square cross-sectional shape for adaption for connection with a socket, said lower end of said handle having a spring-loaded locking member;

a socket member having a first end with a longitudinal cavity for receiving said lower end of said handle, said socket extension first end also having a radial depression to allow said locking member to extend to connect said socket extension with said handle lower end, said socket extension having a lower end having an axial cavity extending therein; and a drive bit for engaging with a threaded fastener, said drive bit having an angular groove for receipt of a lock washer to connect said dry bit with said socket extension lower end to allow an operator to torque a threaded fastener by rotating said hammer head.

2. A multiple function automotive vehicle enclosure door and door lock striker adjustment tool as described in claim 1, wherein said handle is fabricated from a metal and said handle has an encircling polymeric grip.

3. A multiple function automotive vehicle enclosure door and door lock striker adjustment tool as described in claim 1, wherein said handle lower end is adapted to fit in a ⅜ drive socket.

4. A multiple function automotive vehicle enclosure door and door lock striker adjustment tool as described in claim 3, wherein said drive bit is sized to torque a threaded fastener having an English measurement size head.

5. A multiple function automotive vehicle enclosure door and door lock striker adjustment tool as described in claim 3, wherein said bit is sized to torque a metric measurement size head.

6. A multiple function automotive vehicle enclosure door and door lock striker adjustment tool comprising:

a lightweight polymeric hammerhead, said hammerhead having a first diametrically enlarged cylindrical end with an internally threaded blind bore penetrating therein, said hammerhead having a reduced diameter mid-portion allowing an operator to grip said tool, said hammerhead having a second diametrically enlarged cylindrical end opposite said first diametrically enlarged cylindrical end, said second diametrically enlarged end having an internally threaded blind bore extending therein;

a first hard plastic cylindrical impact member having an outer end surface for impact with said automotive vehicle door lock striker, said first impact member having an inner surface with an annular tapered portion and a flat portion, said flat portion having a threaded stud projecting therefrom to allow said first impact member to be threadably connected with said first end of said hammerhead;

a second soft rubber cylindrical impact member having an outer end surface for impact with said vehicle door, said second impact member having an inner surface with an annular tapered portion and a flat portion, said flat portion having a threaded stud projecting therefrom to allow said first impact member to be threadably connected with said second end of said hammerhead;

an elongated metal member providing a handle for said tool, said handle having a top end for insertion into a generally transverse radial bore of said reduced diameter mid-portion of said hammerhead and being fixably connected thereto by a dowel pin, said handle having a lower end having a generally square cross-sectional shape for adaption for connection with a socket, said lower end of said handle having a springloaded locking pin said handle having a polymeric grip encircling said elongated metal member;

a socket member having a first end with a longitudinal cavity for receiving said lower end of said handle, said socket extension first end also having a radial depression to allow said locking pin to extend to connect said socket extension with said handle lower end, said socket extension having a lower end having a hexagonal axial cross-sectional cavity extending therein; and a drive bit for engaging with a threaded fastener, said drive bit having a hexagonal cross-section for receipt into said socket member lower end cavity, said dry bit having an angular groove for receipt of a lock washer to connect said dry bit with said socket extension lower end to allow an operator to torque a threaded fastener by rotating said hammerhead.

* * * * *